United States Patent [19]

Triplett

[11] 3,958,147

[45] May 18, 1976

[54] TRAVELING-WAVE TUBE WITH IMPROVED PERIODIC PERMANENT MAGNET FOCUSING ARRANGEMENT INTEGRATED WITH COUPLED CAVITY SLOW-WAVE STRUCTURE

[75] Inventor: Melvin E. Triplett, Los Angeles, Calif.

[73] Assignee: Hughes Aircraft Company, Los Angeles, Calif.

[22] Filed: June 6, 1975

[21] Appl. No.: 584,681

[52] U.S. Cl. ..... 315/3.5; 315/5.35; 335/210

[51] Int. Cl.[2] ..... H01J 25/34

[58] Field of Search ..... 315/3.5, 3.6, 5.34, 315/5.35; 335/210

[56] References Cited

UNITED STATES PATENTS

| | | | |
|---|---|---|---|
| 3,010,047 | 11/1961 | Bates | 315/3.5 |
| 3,324,339 | 6/1967 | Winslow et al. | 315/5.35 X |
| 3,617,802 | 11/1971 | Manoly | 315/3.5 |
| 3,755,706 | 8/1973 | Scott | 315/3.5 |
| 3,885,192 | 5/1975 | Esterson et al. | 315/3.5 |

*Primary Examiner*—Saxfield Chatmon, Jr.
*Attorney, Agent, or Firm*—W. H. MacAllister; Paul M. Coble

[57] ABSTRACT

A periodic permanent magnet electron beam focusing arrangement integrated with a traveling-wave tube coupled cavity slow-wave structure is disclosed which achieves maximum peak power output in a compact design of minimum size, weight and cost. A plurality of annular permanent magnets and ferromagnetic pole pieces are alternately disposed coaxially about the electron beam path, with the pole pieces extending slightly radially inwardly of the magnets. A number n (where n is a positive integer not less than two) of annular platelike members and (n − 1) annular spacer members, each of electrically conductive nonmagnetic material, are disposed radially within each magnet. The inner circumferential surfaces of the spacer members and of the pole pieces constitute lateral walls for different ones of the slow-wave structure interaction cavities, the broad surfaces of the platelike members constituting end walls for the cavities.

1 Claim, 4 Drawing Figures

TRAVELING-WAVE TUBE WITH IMPROVED PERIODIC PERMANENT MAGNET FOCUSING ARRANGEMENT INTEGRATED WITH COUPLED CAVITY SLOW-WAVE STRUCTURE

This invention relates generally to traveling-wave tubes, and more particularly relates to an improved periodic permanent magnet focusing arrangement integrated with a coupled cavity slow-wave structure for high frequency, high power traveling-wave tubes.

The invention herein described was made in the course of or under a contract or subcontract thereunder with the United States Navy.

In traveling-wave tubes a stream of electrons is caused to interact with a propagating electromagnetic wave in a manner which amplifies the electromagnetic energy. In order to achieve such interaction, the electromagnetic wave is propagated along a slow-wave structure, such as a conductive helix wound about the path of the electron stream or a folded waveguide type of structure in which a waveguide is effectively wound back and forth across the path of the electrons. The slow-wave structure provides a path of propagation for the electromagnetic wave which is considerably longer than the axial length of the structure, and hence, the traveling wave may be made to effectively propagate at nearly the velocity of the electron stream. Interaction between the electrons in the stream and the traveling wave causes velocity modulation and bunching of the electrons in the stream. The net result may then be a transfer of energy from the electron stream to the wave traveling along the slow-wave structure.

The present invention is concerned with traveling-wave tubes utilizing slow-wave structures of the coupled cavity, or interconnected cell, type. In this type of slow-wave structure a series of interaction cells, or cavities, are disposed adjacent to each other sequentially along the axis of the tube. The electron stream passes axially through each interaction cavity, and electromagnetic coupling is provided between each cavity and the electron stream. Each interaction cavity is also coupled to an adjacent cavity by means of a coupling hole in the end wall defining the cavity. Generally, the coupling holes between adjacent cavities are alternately disposed on opposite sides of the axis of the tube, although various other arrangements for staggering the coupling holes are possible and have been employed. When the coupling holes are so arranged, a folded waveguide type of energy propagation results, with the traveling-wave energy traversing the length of the tube by entering each interaction cavity from one side, crossing the electron stream and then leaving the cavity from the other side, thus traveling a sinuous, or serpentine, extended path.

Since the electron stream is projected along the axis of the tube through minimum sized holes in the end walls of the interaction cavities, or more generally as proximate to the slow-wave structure as possible, the electron stream must be precisely constrained to its axial path in order to prevent excessive impingement of electrons on the slow-wave structure. Generally, this is accomplished by immersing the electron stream in a strong axial magnetic field which tends to provide the required focusing so that the electron stream may pass as closely as possible to the slow-wave structure without excessive interception of electrons by the slow-wave structure. In one of the early techniques for providing the constraining axial magnetic field, the slow-wave structure is aligned concentrically within a long solenoid wound of a conductor carrying a relatively large electrical current. Another early focusing scheme for traveling-wave tubes involves the use of a single large permanent magnet, of a length substantially equal to that of the slow-wave structure, disposed about the slow-wave structure with a pole piece at each end of the magnet. While solenoids and permanent magnets have been able to provide satisfactory focusing, the excessive size and weight of these focusing arrangements have made tubes focused in this manner impractical for many mobile applications.

In order to provide more compact focusing devices for traveling-wave tubes, periodic permanent magnetic focusing arrangements were developed in which a plurality of short annular permanent magnets are disposed in axial alignment along and about the slow-wave structure with a plurality of annular ferromagnetic pole pieces interposed between and abutting adjacent magnets. The magnets are magnetized axially and arranged with like poles of adjacent magnets confronting one another so that there is produced, along the axis of the tube, a periodic magnetic field of sinusoidal distribution, with zero field occurring at each pole piece and with a period equal to twice the pole piece spacing.

A significant step in the advancement of the traveling-wave tube electron beam focusing art was made possible by the development of coupled cavity slow-wave structures of the type described above. The focusing means was then actually brought inside the vacuum envelope for the tube by extending the pole pieces of the aforementioned periodic permanent magnet focusing arrangement radially inwardly to the immediate vicinity of the electron stream and by hermetically sealing between each pair of adjacent pole pieces an annular non-magnetic spacer element which is disposed radially within each magnet. The radially inwardly projecting portions of the pieces serve as the end walls of the slow-wave structure interaction cavities, while the inner circumferential surfaces of the annular spacer elements define the lateral walls of the interaction cavities, thereby producing a uniquely combined slow-wave structure and magnetic focusing arrangement. Such an arrangement is disclosed in detail in U.S. Pat. No. 2,985,792, entitled "Periodically Focused Traveling-Wave Tube", issued May 23, 1961 to D. J. Bates et al. and assigned to the assignee of the present invention.

The design of coupled cavity traveling-wave tubes for operation at higher frequencies has necessitated a corresponding reduction in the length of the interaction cavities. When a periodic permanent magnet focusing arrangement integrated with the slow-wave structure interaction cavities in the manner described above is to be used in such high frequency tubes, the lengths of the magnets would be reduced by the same amount as the interaction cavities. This reduction in magnet length can be avoided, however, by forming a plurality of interaction cavities within the bore of each annular magnet. An improved arrangement of this type is disclosed in U.S. Pat. No. 3,324,339, entitled "Periodic Permanent Magnet Electron Beam Focusing Arrangement For Traveling-Wave Tubes Having Plural Interaction Cavities in Bore of Each Annular Magnet", issued June 6, 1957 to L. M. Winslow et al. and assigned to the assignee of the present invention. In this arrangement the ferromagnetic pole pieces extend radially inwardly to the immediate vicinity of the electron stream and additionally serve as some but not all of the interaction cavity end walls.

As the operating frequency of a traveling-wave tube increases, for a given tube power level, the required slow-wave structure dimensions become correspondingly smaller. Thus, in the aforementioned prior art arrangements wherein the focusing structure pole pieces also serve as at least some of the interaction cavity end walls, increases in tube operating frequency are accompanied by a corresponding decrease in pole piece thickness. A point is eventually reached at which the pole piece dimensions required for certain operating frequencies are too thin to carry sufficient magnetic flux to the vicinity of the electron stream to achieve tube operation at the desired power levels. Thicker pole pieces could be employed, of course, by making the magnetic focusing arrangement completely external to the slow-wave structure. However, as the magnetic focusing structure is moved farther away from the electron stream, the amplitude of the magnetic focusing field on the electron stream axis is reduced, and larger magnets are required to properly focus an electron stream of given power level. Eventually, an upper limit is imposed on the power handling capabilities of the traveling-wave tube.

It is an object of the present invention to provide a periodic permanent magnet electron beam focusing arrangement integrated with a traveling-wave tube coupled cavity slow-wave structure which achieves maximum tube peak power output with a highly compact design of minimum size, weight and cost.

It is a further object of the present invention to provide an integrated periodic permanent magnet electron beam focusing arrangement and coupled cavity slow-wave structure which has superior thermal properties, hence higher average power handling capabilities, than previous integrated slow-wave structure/focusing arrangements of this type.

In accordance with the foregoing objects, an arrangement according to the invention includes a plurality of substantially annular permanent magnets magnetized axially and coaxially disposed about the electron beam path with like poles of adjacent magnets confronting one another. A plurality of substantially annular ferromagnetic pole pieces, respectively coaxially interposed between the abutting adjacent magnets, extend radially inwardly of the magnets to a radial distance substantially outwardly of the electron beam path. Each pole piece defines a cylindrical aperture therethrough having a circumferential surface which constitutes the lateral wall of one of the slow-wave structure interaction cavities. A number $n$, where $n$ is a positive integer not less than two, of substantially annular plate-like members of electrically conductive non-magnetic material are disposed coaxially about the electron beam path and radially within each of the magnets. $(n - 1)$ substantially annular spacer members of electrically conductive non-magnetic material are disposed coaxially about the electron beam path and radially within each of the magnets. Each spacer member is disposed axially between a pair of the plate-like members and each defines a cylindrical aperture therethrough having a circumferential surface which constitutes the lateral wall of one of the slow-wave structure interaction cavities. The pole pieces, plate-like members and spacer members are hermetically bonded together. The plate-like members extend radially inwardly of the pole pieces and the spacer members to the vicinity of the electron beam path, with the broad surfaces of the plate-like members constituting end walls of the slow-wave structure interaction cavities. The plate-like members define aligned apertures in their respective central regions to provide a passage for the electron beam. Each plate-like member further defines a coupling hole therethrough in a region radially outwardly of its central region for intercoupling adjacent slow-wave structure interaction cavities.

An arrangement according to the invention allows the magnetic focusing structure to be brought as close as possible to the electron beam path without having the ferromagnetic pole pieces serve as end walls for the slow-wave structure interaction cavities. Not only does this enable most of the slow-wave structure to be made of a material having high thermal conductivity, but in addition, relatively large pole piece thicknesses can be maintained and the amplitude of the magnetic focusing field on the electron beam axis maximized, even though the slow-wave structure dimensions are reduced in order to achieve operation at higher frequencies.

The foregoing, as well as other objects, advantages and characteristic features of the present invention, will become readily apparent from the following detailed description of preferred embodiments of the invention when taken in conjunction with the accompanying drawings in which.

Figure 1:
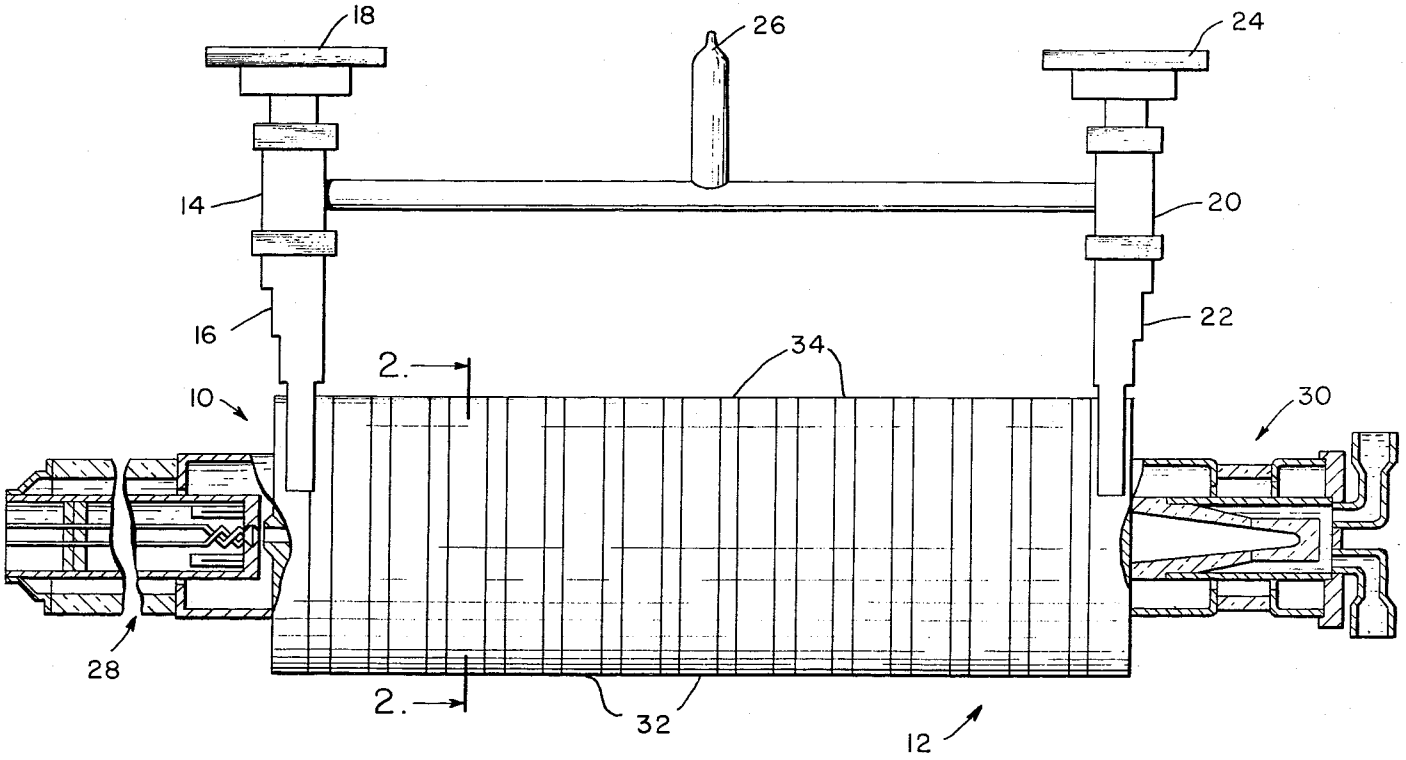
FIG. 1 is an overall view, partly in longitudinal section and partly broken away, illustrating a traveling-wave tube incorporating a magnetic focusing arrangement and slow-wave structure in accordance with the present invention.

Referring with more particularity to the drawings, and especially to FIG. 1, reference numeral 10 designates generally a traveling-wave tube which includes an arrangement 12 of magnets, pole pieces, plate-like members and spacer members which function as a combined slow-wave structure for propagating an electromagnetic wave with a phase velocity substantially less than the velocity of light and a periodic permanent magnet focusing device for focusing the electron beam traversing the length of the slow-wave structure. Coupled to the input end of the arrangement 12 is an input waveguide transducer 14 which includes an impedance step transformer 16. A flange 18 is provided for coupling the assembled traveling-wave tube 10 to an external waveguide or other microwave transmission line (not shown). The construction of the flange 18 may include a microwave window (not shown) transparent to microwave energy but capable of maintaining a vacuum within the traveling-wave tube 10. At the output end of the arrangement 12 an output transducer 20 is provided which is substantially similar to the input transducer 14 and which includes in impedance step transformer 22 and a coupling flange 24, which elements are similar to the elements 16 and 18, respectively, of the input transducer 14. For vacuum pumping the traveling-wave 10 during manufacture, a double-ended pumping tube 26 may be connected to both of the input and output waveguide transducers 14 and 20.

An electron gun 28 is disposed at one end of the traveling wave tube 10 which, although illustrated as the input end in FIG. 1, may alternatively be the output end if a backward wave device is desired. The electron gun 28 functions to project a stream of electrons along the axis of the tube 10 and may be of any conventional construction well known in the art. For details as to the construction of the gun 28, reference is made to the aforementioned U.S. Pat. No. 2,985,792 and to U.S. Pat. No. 2,936,393, entitled "Low Noise Traveling-Wave Tube", issued May 10, 1960 to M.R. Currie et al. and assigned to the assignee of the present invention.

At the opposite end of the traveling-wave tube 10 there is provided a cooled collector structure 30 for collecting the electrons in the stream. The collector 30 is conventional and may be of any form well known in the art. For details as to the construction of the collector, reference is made to the aforementioned U.S. Pat. No. 2,985,792 and to U.S. Pat. No. 2,860,277, entitled "Traveling-Wave Tube Collector Electrode", issued Nov. 11, 1958 to A. H. Iversen and assigned to the assignee of the present invention.

Figure 2:
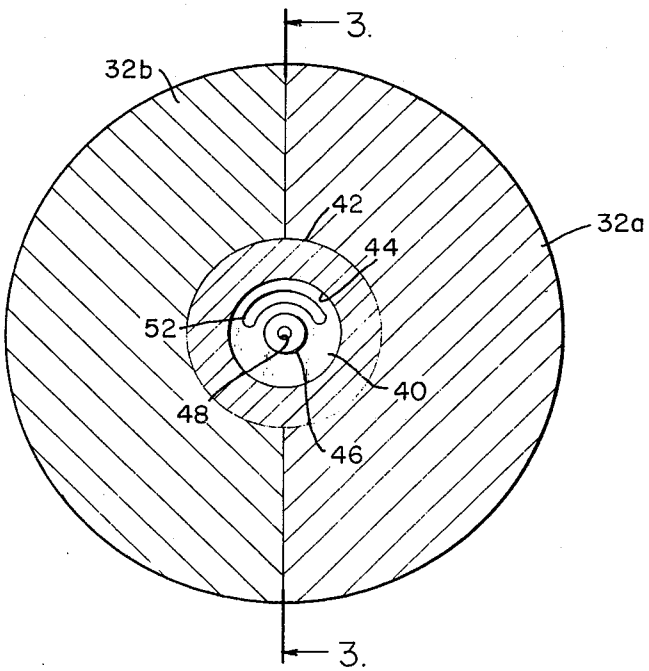
FIG. 2 is a cross-sectional view taken along line 2—2 of FIG. 1.
Figure 3:
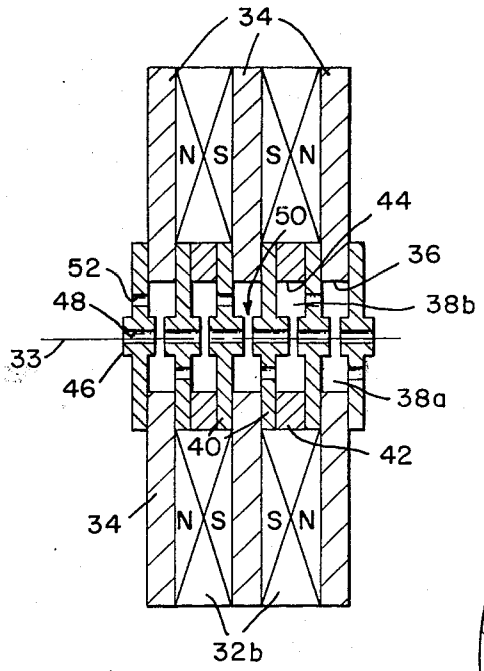
FIG. 3 is a longitudinal sectional view taken along line 3—3 of FIG. 2 and illustrating one magnetic period of a magnetic focusing arrangement and slow-wave structure according to one embodiment of the invention.

The construction of the combined slow-wave structure and focusing arrangement for the traveling-wave tube 10 is illustrated in more detail in FIGS. 2 and 3. A plurality of substantially annular permanent magnets 32 are coaxially disposed about longitudinal axis 33 of the tube 10, with a plurality of substantially annular pole pieces 34 of ferromagnetic material respectively coaxially interposed between and abutting adjacent magnets 32. In a preferred embodiment of the invention the magnets 32 may be of samarium cobalt and the pole pieces 34 of a vacuum melted high purity iron, for example. As is illustrated in FIG. 3, the magnets 32 are arranged along the axis of the tube with like poles of adjacent magnets confronting one another so that a magnetic field reversal occurs at each pole piece 34. Moreover, for convenience during assembling of the tube, the magnets 32 are diametrically split into two sections 32*a* and 32*b*as shown in FIG. 2.

The ferromagnetic pole pieces 34 extend radially inwardly of the magnets 32 but terminate at a radial distance substantially outwardly of the axis 33. Each of the pole pieces 34 defines a cylindrical aperture 36 therethrough coaxially aligned about tube axis 33. The circumferential surfaces of respective apertures 36 constitute the respective lateral walls of certain ones 38*a* of slow-wave structure interaction cavities 38.

Disposed coaxially about the axis 33 radially aradially within each of the magnets 32 are a number $n$ (where $n$ is a positive integer not less than two) of substantially annular plate-like members 40 and $(n - 1)$ substantially annular spacer members 42, each of electrically conductive non-magnetic material. A preferred material for the members 40 and 42 is copper in view of its high thermal conductivity. Each plate-like member 40 and spacer member 42 has an outer diameter substantially equal to the inner diameter of the magnets 32.

In the embodiment shown in FIG. 3, $n$ is equal to two. Hence, two plate-like members 40 and one spacer member 42 are disposed within each magnet 32, with each spacer member 42 disposed axially between and abutting adjacent plate-like members 40. The plate-like members 40, in turn, abut respective portions of the adjacent pole pieces 34 which project inwardly of the magnets 32. The pole pieces 34, plate-like members 40 and spacer members 42 are hermetically bonded together, for example by an appropriate braze material such as a nickel-copper-gold alloy, to form a vacuum envelope for the interior portions of the traveling-wave tube 10. Each spacer member 42 defines a coaxially aligned cylindrical aperture 44 therethrough of a diameter substantially equal to the diameter of apertures 36 in pole pieces 34. The circumferential surfaces of the respective apertures 44 constitute the respective lateral walls of the remaining ones 38*b* of the slow-wave structure interaction cavities 38.

The plate-like members 40 extend radially inwardly of the pole pieces 34 and spacer members 42 to approximately the perimeter of the region adapted to contain the axial electron stream. The plate-like members 40 are constructed in such a manner that a short drift tube, or ferrule, 46 is provided at the inner extremity of each plate-like member 40. The drift tube 46 is in the form of a cylindrical extension, or lip, protruding axially along the path of the electron stream from both surfaces of plate-like member 40, i.e., in both directions normal to the plane of the member 40. The drift tubes 46 are provided with axially aligned apertures 48 in their respective central regions to provide a passage for the flow of the electron stream. Adjacent ones of the drift tubes 48 are separated by a gap 50 which functions as an interaction gap in which energy exchange between the electron stream and the traveling-wave energy traversing the slow-wave structure occurs.

The broad surfaces of the plate-like members 40 constitute end walls for the slow-wave structure interaction cavities 38. For intercoupling adjacent interaction cavities 38, an off-center coupling hole 52 is provided through each of the plate-like members 40 to permit the transfer of electromagnetic wave energy from cavity to cavity. As is illustrated, the coupling holes 52 may be substantially kidney-shaped and may be alternately disposed 180° apart with respect to the tube axis 33. It should be pointed out, however, that the coupling holes 52 may be of other shapes and may be staggered in various other arrangements, such as those disclosed in U.S. Pat. No. 3,101,047, entitled "Traveling-Wave Tube", issued Nov. 21, 1961 to D. J. Bates and assigned to the assignee of the present invention.

Figure 4:
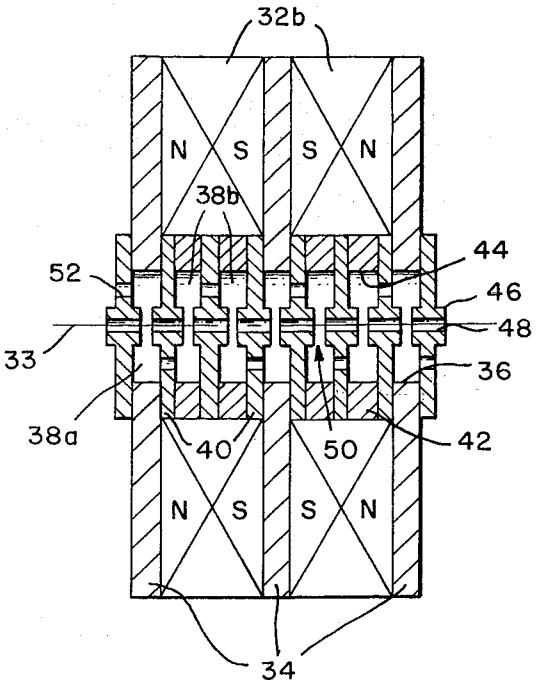
FIG. 4 is a longitudinal sectional view similar to FIG. 3 showing a magnetic focusing arrangement and slow-wave structure according to another embodiment of the invention.

Since the lengths of the slow-wave structure interaction cavities 38 are determined by the axial extent, or thickness, of the pole pieces 34 and the spacer members 42, the pole pieces 34 have a thickness substantially equal to that of the spacer members 42. It is pointed, however, that although the respective lengths of the various interaction cavities 38 are substantially the same, they may be varied slightly with respect to each other so that the effective axial length of the cavities 38 is varied as a function of distance along the tube axis 33 to ensure that the desired interaction between the electron stream and the traveling waves will continue to a maximum degree even though the electrons are decelerated toward the collector end of the tube. Another embodiment of the present invention is illustrated in FIG. 4. Components in the embodiment of FIG. 4 are the same as respective components in the embodiment of FIG. 3 and thus are designated by the same reference numerals as their counterpart components in FIG. 3. However, in the embodiment of FIG. 4,

$n$ is equal to three. Hence, three plate-like members 40 and two spacer members 42 are alternately coaxially disposed radially within each annular magnet 32 in abutting hermetically bonded relationship.

Integrated magnetic focusing and slow-wave structure arrangements in acordance with the invention are especially suitable for use in traveling wave tubes designed to operate at Ka-band frequencies, i.e., frequencies substantially in the range 26–40 gHz, although the invention is in no way limited to use at such frequencies. As a specific example for illustrative purposes, an arrangement according to FIG. 4 and designed to operate at a center frequency of 33 gHz may be constructed with the following exemplary dimensions:

| Parameter | Dimension (inches) |
|---|---|
| Outer diameter of magnets 32 | 1.2 |
| Inner diameter of magnets 32 | 0.4 |
| Thickness of magnets 32 | 0.209 |
| Thickness of pole pieces 34 and spacer members 42 | 0.064 |
| Inner diameter of spacer members 42 | 0.14 |
| Thickness of plate-like members 40 | 0.027 |
| Diameter of drift tubes 46 | 0.072 |
| Diameter of drift tube apertures 48 | 0.051 |
| Axial extent of interaction gaps 50 | 0.0228 |

An arrangement constructed according to FIG. 4 with the foregoing dimensions and samarium cobalt magnets has been found to provide a peak axial magnetic field of almost 5,000 Gauss. Excellent electron beam transmission was achieved for a beam voltage of about 30 Kv and a beam current of about 1 amp.

Arrangements according to the invention allow the magnetic focusing structure to be brought as close as possible to the electron beam path without having the ferromagnetic pole pieces 34 serve as end walls for the interaction cavities 38. Thus, even though the slow-wave structure dimensions are reduced in order to achieve operation at higher freqencies, pole piece thicknesses substantially greater than that of the plate-like members 40 can be employed. As a result, the amplitude of the magnetic focusing field on the electron beam axis 33 can be maximized to provide maximum peak power output in a highly compact design of minimum size, weight and cost. In addition, since most of the slow-wave structure is made of a material having high thermal conductivity, excellent average power handling capabilities can be achieved. Moreover, since none of the coupling holes 52 which interconnect adjacent interaction cavities 38 are formed in the magnetic focusing circuit, highly uniform focusing fields can be achieved, thereby maximizing electron beam transmission along the tube.

Although the present invention has been shown and described with reference to particular embodiments, nevertheless various changes and modifications which are obvious to a person skilled in the art to which the invention pertains are deemed to lie within the spirit, scope and contemplation of the invention.

What is claimed is:

1. A device for focusing a stream of electrons and constraining it to flow along a predetermined path and for providing a series of electromagnetically intercoupled interaction cavities arranged sequentially along said predetermined path in electromagnetic interacting relationship with said stream of electrons, comprising:

a plurality of substantially annular permanent magnets magnetized axially and coaxially disposed about said predetermined path with like poles of adjacent magnets confronting one another;

a plurality of substantially annular ferromagnetic pole pieces respectively coaxially interposed between and abutting adjacent ones of said magnets and extending radially inwardly of said magnets to a radial distance substantially outwardly of said predetermined path, each of said pole pieces defining a cylindrical aperture therethrough having a circumferential surface which constitutes the lateral wall of one of said interaction cavities;

first, second and third substantially annular plate-like members of electrically conductive non-magnetic material disposed coaxially about said predetermined path and radially within each of said magnets, said first and third plate-like members abutting and being hermetically bonded to the respective pole pieces abutting opposite ends of the said magnet, said second plate-like member being disposed axially substantially midway along the length of the said magnet;

first and second substantially annular spacer members of electrically conductive non-magnetic material disposed coaxially about said predetermined path and radially within each of said magnets, said first spacer member being disposed axially between and abutting said first and second plate-like members and being hermetically bonded thereto, said second spacer member being disposed axially between and abutting said second and third plate-like members and being hermetically bonded thereto, each of said spacer members defining a cylindrical aperture therethrough having a circumferential surface which constitutes the lateral wall of one of said interaction cavities;

each of said plate-like members extending radially inwardly of said pole pieces and spacer members to the vicinity of said predetermined path, the broad surfaces of said plate-like members consituting end walls of said interaction cavities, said plate-like members defining aligned apertures in their respective central regions to provide a passage for said stream of electrons, and each said plate-like member further defining a coupling hole therethrough in a region radially outwardly of its central region for intercoupling adjacent interaction cavities.

* * * * *